United States Patent [19]

Gessler et al.

[11] 3,985,244

[45] Oct. 12, 1976

[54] SILO, OR BIN, FOR FLOWABLE SOLID MATERIAL

[75] Inventors: Hans Gessler, Aalen; Josef Faul, Wasseralfingen, both of Germany

[73] Assignee: Schwabische Huttenwerke Gesellschaft mit beschrankter Haftung, Wasseralfingen, Germany

[22] Filed: Nov. 11, 1974

[21] Appl. No.: 522,928

[30] Foreign Application Priority Data

Nov. 9, 1973 Germany ..... 2356054

[52] U.S. Cl. ..... 214/17 D; 222/328; 222/459

[51] Int. Cl.[2] ..... B65G 65/48

[58] Field of Search ..... 214/17 R, 17 D, 17 DA; 193/32; 222/328, 459, 564

[56] References Cited

UNITED STATES PATENTS

| | | | |
|---|---|---|---|
| 1,121,758 | 12/1914 | Phelps et al. | 222/328 X |
| 3,081,009 | 3/1963 | Cooper | 222/459 |
| 3,710,959 | 1/1973 | Gessler | 214/17 D |

FOREIGN PATENTS OR APPLICATIONS

| | | | |
|---|---|---|---|
| 1,226,942 | 10/1966 | Germany | 214/17 D |
| 1,218,355 | 6/1966 | Germany | 214/17 D |

*Primary Examiner*—Robert G. Sheridan
*Attorney, Agent, or Firm*—Walter Becker

[57] ABSTRACT

A silo, or bin, for flowable materials, especially heavy particulate solid materials. The bin has a bottom wall with a cylindrical wall upstanding therefrom. The bottom wall has a radial discharge opening formed therein and a rotor positioned above the bottom wall sweeps material into the opening. The bin has a guiding body on the axis which tapers in the downward direction and mounted inside the bin side wall are brake members which incline downwardly toward the axis of the bin and are preferably within the axial range of the guiding body.

11 Claims, 15 Drawing Figures

SILO, OR BIN, FOR FLOWABLE SOLID MATERIAL

The present invention relates to a silo for heavy flowing or non-flowing pourable materials such as chips, fibers, silage, scraps, compost, filter cake or the like which silo has a bin bottom and a bin wall which is vertical at least within the region of said bin bottom. More specifically, the invention relates to a silo of the above mentioned type in which above the discharge opening located at the lower section of the silo there is provided at least one displacing body with a downwardly inclined guiding surface which is at least partially located between the vertical silo axis and the silo wall, said silo having associated therewith a discharging device, the discharging rotor of which is located above the bin bottom and is at least partially spaced from and below said guiding surface.

The column of pourable material of a silo, especially of a high bin is able to be considerably compacted by its own weight. The horizontal and vertical pressures occurring within a certain region can be calculated by an *e*-function in conformity with the height of the column of pourable materials. With heavy or non-flowing pourable materials for which the device according to the invention is particularly intended and which can be withdrawn from silos and bins only through specific discharge devices, there exists the danger that the mechanical means for such withdrawal, such as discharge milling tools, discharge worms and discharge rotors are overloaded and prematurely break. At best correspondingly high driving forces are required and the wear of the parts impacted upon by the pourable material is correspondingly high.

It is, therefore, an object of the present invention so to design a silo for pourable materials of the above mentioned general type that within the discharge region, for instance within the region of the discharge opening, and a discharge device provided in said region, an effective relief will be obtained without materially affecting the gravitational flow within the column of the pourable material. These and other objects and advantages of the invention will appear more clearly from the following specification in connection with the accompanying drawings, in which:

FIG. 1 represents a diagrammatic vertical section through a silo for pourable goods provided with a relieving device according to the invention.

FIGS. 2 and 3 respectively illustrate two further embodiments of the invention in section similar to FIG. 1.

FIG. 4 is a top view of the silo according to FIG. 3.

FIGS. 5 and 6 respectively illustrate two further embodiments of the silo according to the invention.

The silo according to the present invention is characterized primarily in that the downwardly and outwardly inclined guiding surface is arranged symmetrically preferably rotation symmetrically with regard to the vertical central axis of the bin.

Figure 1:
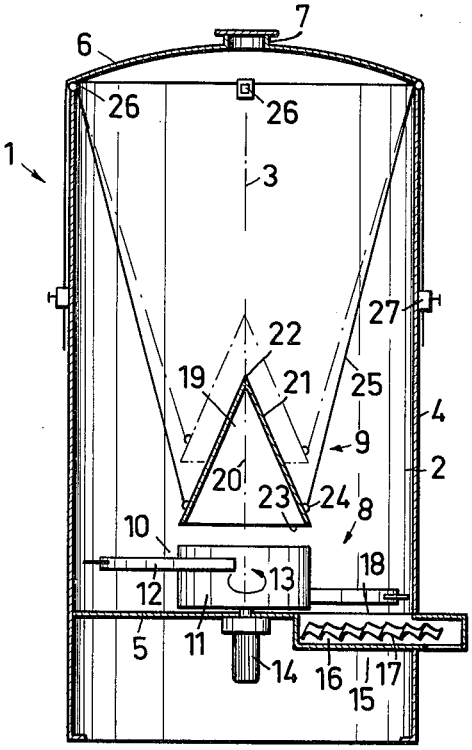

Referring now to the drawings in detail, FIG. 1 shows a silo 1 for pourable material which comprises a bin 2 with a cylindrical bin mantle 4 extending around the vertical bin axis 3 and over the entire height of the bin. The silo furthermore comprises a bin bottom 5 which is substantially plane and while being at a right angle to the bin axis 3 is located above the base of the silo. The silo 1 furthermore comprises a bin roof 6 which is urged in upward direction similar to a calotte and which may have an opening 7 adapted to be closed.

Within the lower region of the bin 2 there is provided a discharging device 8 above which there is located the relieving body 19.

The discharge opening 18 in bottom wall 5 is symmetrically located to an axial plane of the bin axis 3 so that it coincides with the worm trough 16. When the discharge rotor 10 turns, the rotor arms 12 feed the silo material over the bin bottom 5 into the region of the outlet opening 18 so that the silo material passes into the worm conveyor 15 and from the latter is conveyed to the outside of the silo 1.

The relieving device 19 comprises a conical displacement body forming an acute angle while its central axis is located approximately in the bin axis 3 and while its outer mantle surface forms a conical guiding surface 21 with the tip 22 located at the top. In view of this design, the pourable material can be displaced from the center of the bin mantle toward the outside so that an accumulation at the upper end of the guiding surface 21 can easily be avoided. The plane bottom side 23 of the displacement body 19 which is at a right angle to the central axis 20 has approximately the same diameter as the rotor body 11 and in spaced relationship to the likewise plane top side of said rotor body is located above said top side. The height of the displacement body 19 is at least twice the height of the discharge rotor 10 or the drum shaped rotor body 11.

For obtaining a safe mounting, there are connecting members 24 provided to which the lower ends of pull members 25 for instance cables are connected. These connecting members 24 are arranged in slightly spaced relationship to each other above the bottom side 23 or below the center of the height of the displacement body 19 and on the outer circumference thereof are uniformly distributed around the central axis 20. Expediently, there are provided at least three pull members 25 which are uniformly distributed around the circumference. The pull members 25 extend from the displacement body 19 at an acute angle to the bin axis 3 in upward direction toward the upper rim of the bin mantle 4 and there by deviating elements 26 are deviated downwardly to the outside of the bin mantle 4 where they engage arresting and adjusting elements 27. In this way the displacement body 19 can easily be adjusted from the outside of the bin. By adjusting the pull members 25, the position of the suspended displacement body 19 can in a simple manner be changed parallel to the bin axis 3 and also transverse thereto in such a way that the displacement body 19 can be adjusted in conformity with the position indicated by dash lines in FIG. 1 so as to be in alignment with the bin axis 3, in the direction of the height as well as laterally in such a way relative to the bin axis 3 that its central axis 20 is either parallel to the bin axis 3 or with a tilted position of the displacement body 9 is at an incline. In this way it is possible to adapt to the respective prevailing conditions the position of the guiding surface 21 for obtaining an optimum effct. Since the guiding surface 21 is arranged in spaced relationship to the bin mantle 4 and/or is arranged in spaced relationship to the bin axis 3, particularly within the region of the bin mantle 4, an uninterrupted flow of the pourable material is assured. The height and the position of the displacement body 19 relative to the vertical bin axis 3 must be ascertained by tests with pourable materials having critical flow behavior, in which connection an eccentric position of the displacement body may be expedient, especially when the outwardly extending conveyor elements 15 which are provided on the bin bottom 5 are arranged asymmetrically. The projecting surface of the displacement body 19 is expediently selected so large that an effective relief of the discharge device 8 is effected which latter is arranged below the displacement body, but the projection surface is so small that the pourable material can under the influence of gravitation and without forming bridges pass through the free cross section between silo mantle and displacement body.

Figure 3:
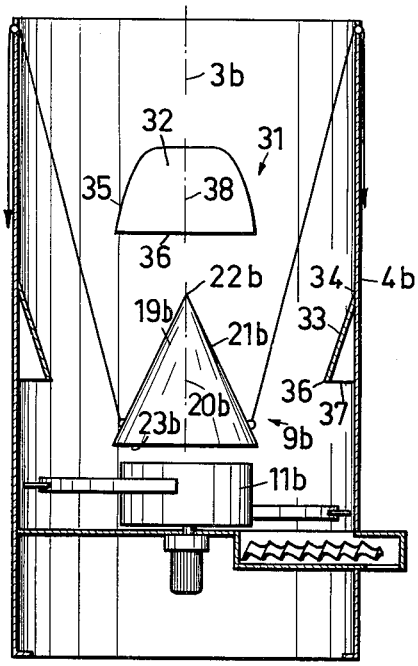
Figure 4:
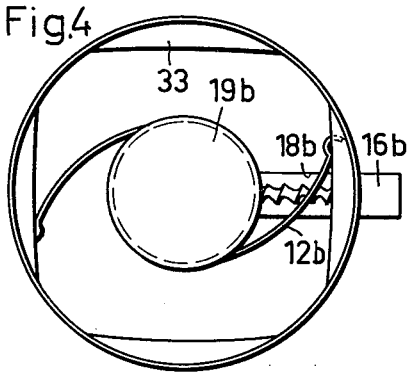
Figure 2:
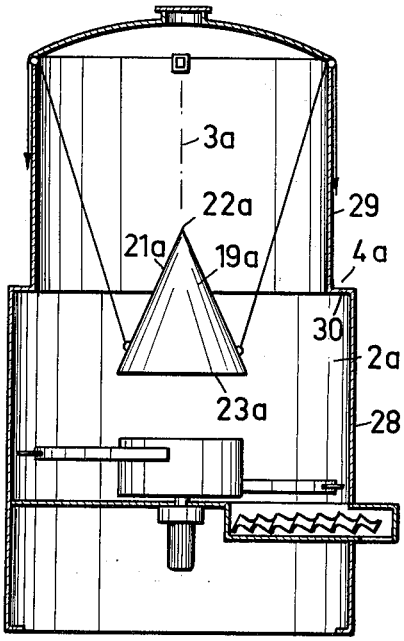
Figure 5:
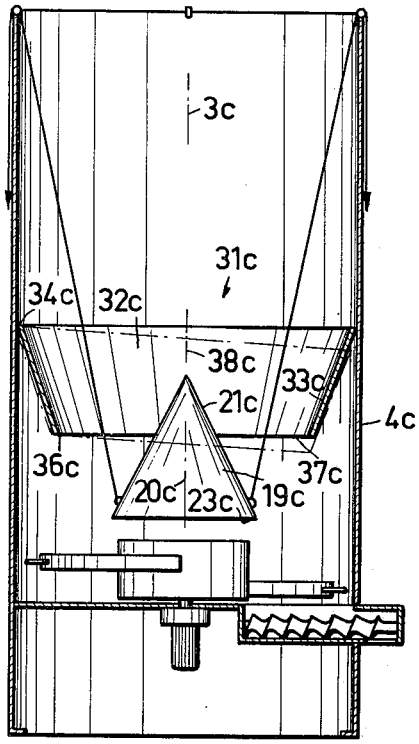

In FIGS. 2 to 15, corresponding elements have been designated with the same reference numerals as in FIG. 1 but in FIG. 2 are provided with the index *a* and in FIGS. 3 and 4 are provided with the index *b*, and in FIGS. 5 are provided with the index *c*.

Figure 7:
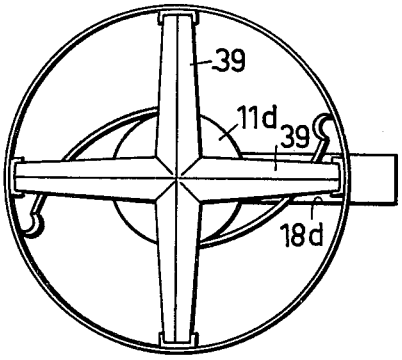
FIG. 7 is a top view of the silo according to FIG. 6.
Figure 6:
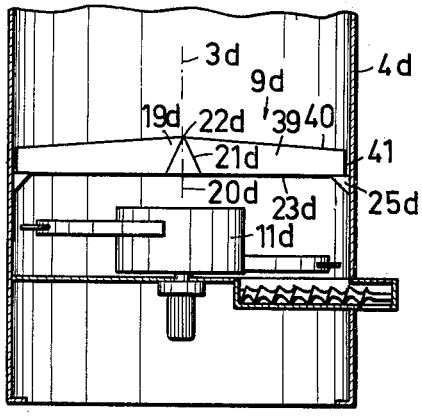
Figure 12:
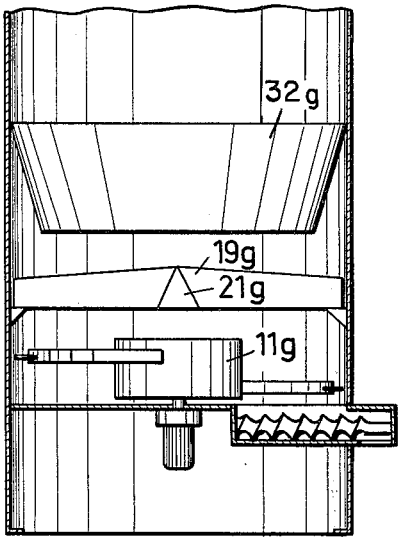
FIG. 12 shows a vertical section through a further embodiment of a silo according to the invention.
Figure 10:
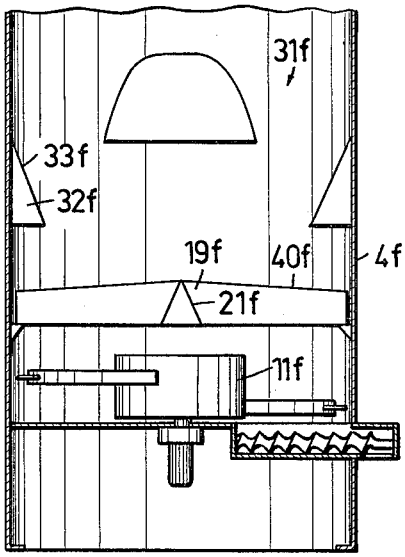
FIG. 10 represents a vertical section through another embodiment of a silo according to the invention.
Figure 13:
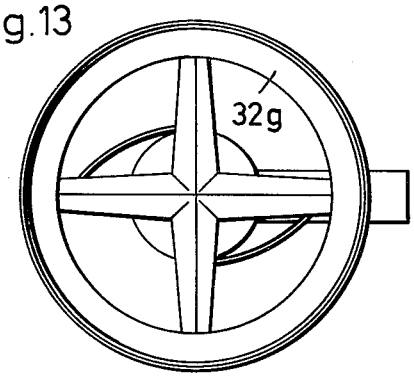
FIG. 13 is a top view of the silo according to FIG. 12.
Figure 11:
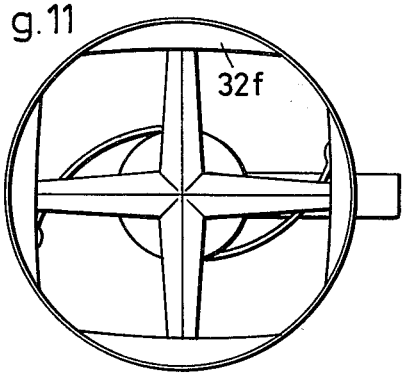
FIG. 11 is a top view of the silo according to FIG. 10.
Figure 15:
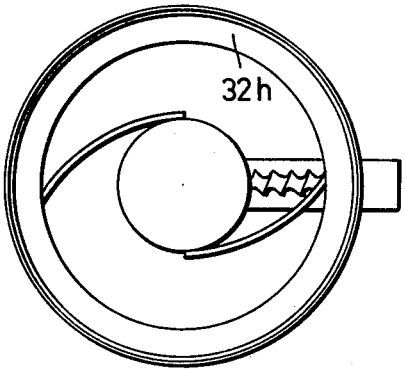
FIG. 15 is a top view of the silo according to FIG. 14.
Figure 14:
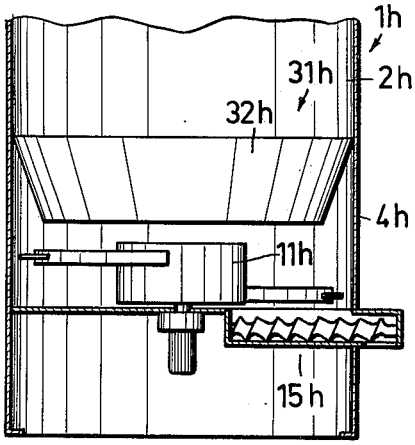
FIG. 14 illustrates a vertical section through still another embodiment of a silo according to the invention.

In FIGS. 6 and 7 the index *d* has been provided. In FIGS. 10 and 11 the index *f* has been provided. In FIGS. 12 and 13 the index *g* has been provided. In FIGS. 14 and 15 the index *h* is provided.

The embodiment according to FIG. 2 differs from that of FIG. 1 primarily by the design of the bin mantle **4*a* which has a lower section 28 with an increased diameter and an upper likewise cylindrical section 29 with a somewhat shorter diameter but which is likewise cylindrical. The two sections 28, 29 merge through an annular disc-shaped merging section 30 with each other, said section 30 being of an annular disc shaped form and extending at a right angle with regard to the bin axis 3*a*. This merging section 30 is located above the bottom side 23*a* of the displacement body 19*a* which means above the largest displacement cross section of said displacement body 19*a* and according to all probability also above the center of the height of the displacement body 19*a* but below its tip 22*a*. The upper mantle section 29 is higher than the lower mantle section 28. The height of the lower mantle section 28 is considerably less than its diameter namely only half as great. This embodiment is particularly suitable when for a specific pourable material no displacement body projection surface can be found which meets the above mentioned requirements namely an efficient relief on one hand and a good gravitational flow of the pourable material on the other hand. With the embodiment of FIGS. 3 and 4, in addition to the relieving device 19*b* there is provided an additional braking device 31 for the pourable material which has likewise a relieving effect. This braking device 31 has a plurality (in the specific showing 4) brake bodies 32 which are uniformly distributed around the bin axis 3*b*. These brake bodies 32 are of the same design but are arranged at different heights for instance in such a way that always two brake bodies 32 are located diametrically opposite to each other. The brake bodies 32 are connected to the bin mantle 4*b* and form a plane braking surface 33 which is inclined in a direction opposite to the guiding surface 21 but at a smaller angle. The upper end 34 of the brake surface 33 merges similar to its lateral edges 35 with the bin mantle 4*b*, whereas the lower end 36 that is confined by the bottom side 37 of the respective brake body 32 and extends at a right angle to the bin axis 3*b* projects beyond the bin mantle 4*b* inwardly. Each brake surface 33 is substantially symmetrically arranged with regard to an axial plane of the bin axis 3*b* while when viewed as top view according to FIGS. 4 adjacent brake surfaces 33 are with reference to the bin axis 3*b* spaced from each other by a distance along an arc which is smaller than the arc angle defined by the brake surface 33. According to the illustrated embodiment, two brake surfaces 33 are arranged in spaced relationship to each other above the bottom side 23 of the displacement body 19*b*, and two brake surfaces are located above the tip 22*b* of said displacement body 19*b*. As a result thereof any bridges which should try to form in the silo material can particularly well be collapsed while only a relatively small displacement effect is obtained. The greatest displacement diameter of the displacement body 19*b* as it is formed by the bottom side 23*b* is slightly greater than the diameter of the rotor body 11*b*. The effect of the braking device 31 is similar to that of the design of the bin mantle 4*a* in conformity with FIG. 2. According to the top view shown in FIG. 4, the brake bodies 32 of the braking device 31 are for purposes of improving the gravitational flow of the pourable material uniformly distributed about a central axis which is designated partial axis 38. This axis 38 will with the illustrated embodiment coincide with the bin axis 3*b* and as the case may be with the central axis 20*b*. The constriction of the cross section of the bin mantle 4*b* formed by the brake body 32 corresponds approximately to the constriction of said cross section as formed by the displacement body 19*b*. With the same cross-sectional constriction, the cross sectional constriction which is caused by the brake body 32 and originates at the bin mantle 4*b* impedes the gravitational flow considerably less than the constriction caused by the displacement body 19*b* in the direction toward the bin wall. This can be further improved when the brake surface 33 has at the maximum the same preferably a smaller angle of inclination than the guiding surface 21*b*. Since the braking surface 33 is located completely above the maximum cross section of the displacement body 19*b***, it is possible over a relatively great height of the column of pourable material to exert a braking and guiding effect upon the pourable material and to avoid too strong local cross sectional constrictions.

It is also possible to provide the described braking surfaces 33, especially the truncated cone-shaped braking surface, to provide without guiding surfaces **21*b*** alone in a bin.

With the embodiment illustrated in FIG. 5, the braking device **31*c* is primarily formed by a single truncated cone-shaped braking body 32*c* which narrows in downward direction. The greatest diameter of said braking body 32*c* which diameter at its plane top side 34*c* at a right angle with regard to the partial axis 38*c* nearly equals the inner diameter of the bin mantle 4*c*, said braking body 32*c* being formed by a thin mantle. The inner side of the braking body 32*c* forms the inner surface 33*c* while the bottom side 37*c* of the braking body 32*c* is parallel to its top side 32*c* and is located above the bottom side 22***c* of the displacement body 19*c*. The braking body 32*c* is for purposes of adaptation to the respective conditions so variable as to location by non-illustrated means for instance pull elements in a manner similar to the displacement body 19*c*, that the braking body 32*c* may for instance occupy the tipped position illustrated in FIG. 5 by dot-dash lines. In this tipped position the partial axis 38*c* of said braking body 32*c* is located at an incline with regard to the bin axis 3*c* and central axis 20*c* whereby the position of the flow zone of the column of pourable material can be determined for instance in such a way that this flow zone is located outside the bin center. This is of advantage for instance with an asymmetric arrangement of the outwardly leading conveying means on the bin bottom.

The braking body 32*c* may in a simple manner also later be mounted on a bin because it is employed as a separate structural element in the bin mantle 4*c*.

FIGS. 6 and 7 illustrate a further embodiment of a relieving device 9*d* which comprises primarily a star-shaped displacement body 19*d* located along the bin axis 3*d*. The arms 39 of said displacement body 19*d* which are located at a right angle to the bin axis 3*d* extend approximately up to the bin mantle 4*d* so that a simple connection of the guiding body is possible. For purposes of avoiding an accumulation at the upper end of the guiding surface 21*d*, the arms 39 are as to their cross sections designed symmetrically with regard to the respective pertaining axial plane of the bin axis 3*d* in an acute angle triangular shape with the longitudinal edge 40 located at the upper end. The longitudinal edges 40 ascend flatly toward the bin axis 3*d* so that in the bin axis 3*d* or at the point of intersection of the arms 39 at the top side of the displacement body 19*d*, a tip 20*d* is formed. The number of the guiding surfaces 21*d* may be adapted to the silo cross section, the silo volume, and the property of the pourable material, especially its flow properties. Between the guiding surfaces there are obtained relatively great through-flow cross sections for the pourable material said through-flow cross sections guiding in the direction toward the bin mantle 4*d*.

The cross sections of the arms 39 thus decrease in the direction toward the bin mantle 4*d* while their supports 23*d* are located in a common plane which is located above the rotary body 11*d* and extends at a right angle to the bin axis 3*d*. The lateral surfaces of the arms 39 from the inclined stripe-shaped guiding surfaces 21*d* which up to their end edges 41 directly adjacent to the bin mantle 4*d* slightly decrease as to height. The average height of the guiding surfaces 21*d* equals its distance from the top side of the rotor body 11*d*. With this design, the guiding surface 21*d* may be selected relatively low.

The displacement body 19*d* is connected to the bin mantle 4*d* preferably at the height of the guiding surfaces 21*d*. As a result thereof a particularly stable connection is possible for which reason this design is particularly well suitable for pourable materials with a high pourable weight. On the inside of the bin mantle 4*d*, below each arm 39 there is connected a bearing 25*d* formed by a support, on which the respective arm 39 adjacent to its free end while with its bottom side 23*d* being secured against turning about the bin axis 3*d*. The bearings 25d will in no way impede the flow of the pourable materials. The guiding surface 21*d* is thus provided on a displacement body which is separate from the discharge rotor and does not turn therewith.

The displacement body 19*d* is with the illustrated embodiment so designed that when viewed in top view according to FIG. 7 it does not completely cover the rotary body 11*d*. One arm 39 on the pertaining guiding surface will be located above the discharge opening 18*d*, preferably symmetrically thereto and will cover the same in upward direction nearly completely.

Figure 8:
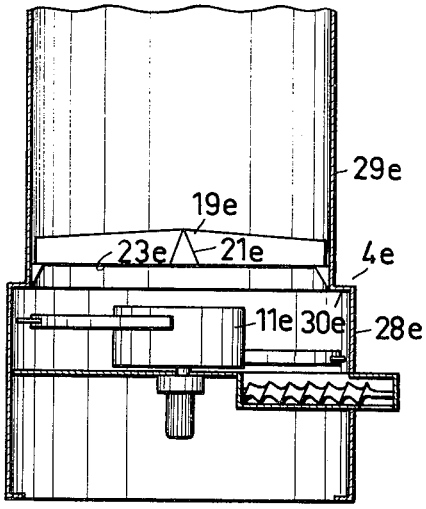
FIG. 8 represents a diagrammatic vertical section through a silo for pourable goods in another embodiment according to the invention.
Figure 9:
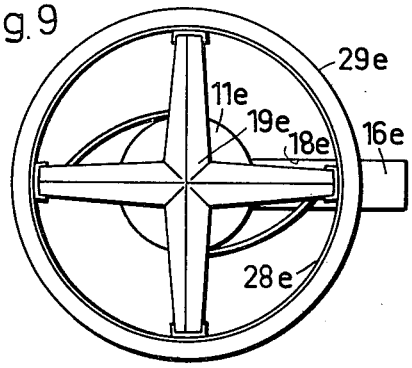
FIG. 9 is a top view of the silo according to FIG. 8.

According to the embodiment shown in FIGS. 8 and 9, the design of the displacement body according to FIGS. 6 and 7 is combined with a design of the bin mantle according to FIG. 2. The merging section 30*e* between the two mantle sections 28*e*, 29*e*, however, is located below the displacement body 19*e* at half the height between the bottom side of said displacement body and the top side of the rotor body 11*e* so that the cross sectional widening for the through-flow of the silo material is provided only below the guiding surfaces 21*e*.

With the embodiment according to FIGS. 10 and 11, above the star-shaped displacement body 19*f* there is provided a braking device 31*f* according to FIGS. 3 and 4. All braking bodies 32*f* or the braking surfaces 33*f* are located in spaced relationship to and above the displacement body 19*f*. The last mentioned distance is greater than the distance 19*f* from the rotor body 11*f*.

With the embodiment according to FIGS. 12 and 13, a truncated cone-shaped braking body 32*g* is in conformity with FIG. 5 provided in spaced relationship to and above the star-shaped displacement body 19*g* while the distance between the braking body 32*g* and the displacement body 19*g* approximately equals the distance between the displacement body 19*g* and rotor body 11*g*.

As shown in FIGS. 14 and 15, it is also possible in the bin 2*h* of the silo 1*h* to provide only one braking and relieving device 31*h* formed by truncated cone-shaped braking body 32*h*, without providing guiding surfaces which face toward the bin mantle or are located directly opposite thereto and are formed by a displacement body. The braking body 32*h* is expediently arranged in slightly spaced relationship to and directly above the rotor body 11*h*. The smaller diameter of the braking body 32*h* is in this connection considerably greater than that of the rotor body 11*h*.

It is, of course, to be understood that the present invention is, by no means, limited to the specific showing in the drawings but also comprises any modifications within the scope of the appended claims.

What is claimed is:

1. A bin or silo, for flowable solid materials comprising; a bottom wall, a side wall connected to and upstanding from said bottom wall, a discharge opening formed in said bottom wall, a rotatable discharge member in the bin above said bottom wall for moving material into said discharge opening, and at least one displacement body means supported in said bin above said discharge member and guiding surface means thereon inclined in the vertical direction, said body means being mounted on the axis of the bin and the guiding surface means thereon tapering outwardly in the downward direction and having a pointed upper end, support means adjustably supporting said body means on the axis of said bin and operable for tilting the body means about at least one axis extending transversely of the bin, said support means including a plurality of flexible elements connected to the lower end of said body means and extending upwardly therefrom, diverting members spaced about the upper end of the bin and about which respective ones of said elements are entrained, and pull members connected to said elements at the free ends thereof.

2. A bin according to claim 1 in which said discharge opening is in the form of a radial opening in said bottom wall, a trough underneath said opening, and a screw conveyor rotatable in said trough.

3. A bin, or silo, for flowable solid material comprising: a bottom wall, a side wall connected to and upstanding from said bottom wall, a discharge opening formed in said bottom wall, a rotatable discharge member in the bin above said bottom wall for moving material into said discharge opening, and at least one displacement body means supported in said bin above said displacement member and guiding surface means thereon inclined in the vertical direction, said body means being centrally mounted on the bin and the guiding surface means thereon tapering outwardly in the downward direction and having a pointed upper end, support means adjustably supporting said body means on said bin and operable for tilting the body means about at least one axis extending transversely of the bin, said support means including a plurality of pull elements connected to said body means at speced points and extending upwardly therefrom to a position for access externally of said bin.

4. A bin according to claim 3 in which said side wall includes an enlarged section therein at the lower end, the upper end of which is within the range of the lower end of said body means.

5. A bin according to claim 4 in which the increase in area of the bin provided by said enlarged section is about equal to the amount of restriction of the bin provided by said body means.

6. A bin according to claim 3 including diverting members spaced about the upper end of the bin and about which pull members are entrained for change of position of said displacement body means.

7. A bin according to claim 6 including arresting and adjusting elements located externally of said bin to fix position of said displacement body means.

8. A bin according to claim 3 wherein said displacement body means has a height smaller than half the diameter of the bin.

9. A bin according to claim 3 wherein at least two braking devices are provided completely above said displacement body means, said braking devices projecting downwardly and being located across from each other at an inclined to said side wall.

10. A bin according to claim 9 wherein four brake bodies are provided.

11. A bin according to claim 9 wherein angle of inclination of said braking devices is smaller than angle of inclination of said guiding surface means on said displacement body means.

* * * * *